US005215302A

United States Patent [19]

Bedzyk

[11] Patent Number: 5,215,302

[45] Date of Patent: Jun. 1, 1993

[54] REGISTRATION MECHANISM FOR SHEETS OF DIFFERENT SIZES

[75] Inventor: Mark D. Bedzyk, Rochester, N.Y.

[73] Assignee: Eastman Kodak Company, Rochester, N.Y.

[21] Appl. No.: 889,583

[22] Filed: May 28, 1992

[51] Int. Cl.[5] ..... B65H 9/06

[52] U.S. Cl. ..... 271/239; 271/250

[58] Field of Search ..... 271/250, 251, 239, 240

[56] References Cited

U.S. PATENT DOCUMENTS

| | | | |
|---|---|---|---|
| 759,971 | 5/1904 | Hallstream . | |
| 3,754,755 | 8/1973 | Krochert . | |
| 3,921,974 | 11/1975 | Miciukiewicz . | |
| 3,948,509 | 4/1976 | Becker . | |
| 3,970,299 | 7/1976 | Berger et al. . | |
| 4,143,755 | 3/1979 | Keller | 271/250 X |
| 4,607,831 | 8/1986 | Raybuck . | |
| 4,660,819 | 4/1987 | Allocco, Jr. et al. . | |
| 4,685,793 | 8/1987 | Sawada et al. . | |
| 4,727,252 | 2/1988 | Yoshimura et al. . | |
| 4,861,012 | 8/1989 | Shimizu . | |
| 5,004,220 | 4/1991 | Dreschel et al. . | |
| 5,014,972 | 5/1991 | Anderson et al. . | |
| 5,031,894 | 7/1991 | Bedzyk et al. . | |
| 5,080,345 | 1/1992 | Daniels | 271/250 X |

FOREIGN PATENT DOCUMENTS

| | | | |
|---|---|---|---|
| 75745 | 4/1986 | Japan | 271/250 |

*Primary Examiner*—Richard A. Schacher
*Attorney, Agent, or Firm*—Frank Pincelli

[57] ABSTRACT

A mechanism for registering sheets of different sizes relative to a station which includes a surface for receiving a sheet, and a registration member located along the surface and extending toward the station for guiding the sheet toward the station. A first urging guide extends along the surface in spaced relation to the registration member. A second urging guide rotates about an axis parallel to the guide and below the platen between an operational position and an non-operational position. When the movable guide is in its operational position, it is located between the first guide and the registration member. A spring is provided for locking the guide in either the operational or non-operational position.

19 Claims, 21 Drawing Sheets

REGISTRATION MECHANISM FOR SHEETS OF DIFFERENT SIZES

BACKGROUND OF THE INVENTION

The invention relates to a mechanism for registering sheets of different sizes relative to a station.

Sheet registration mechanisms of various kinds are known in the art. For example, U.S. Pat. No. 4,660.819, which issued on Apr. 28, 1987, discloses a sheet registration device in a document handler of the kind used with electrographic copying apparatus wherein a set of document sheets are recirculated one or more times from the tray to a copying position and then returned to the tray. The handler of the patent has a tray surface on which sheets rest, and a sidewall or guide along one side edge of the tray surface which terminates in an inclined ramp at the surface. A similar inclined ramp is provided on the other side of the tray. The two ramps are generally parallel to each other along opposite side edges of the tray. These ramps assist in registration of the document sheets in a corner of the tray prior to feeding of the sheets to the copying position.

Known sheet registration mechanisms may require a force other than gravity to be used for proper positioning of the sheet in the registration mechanism. In the above-mentioned patent, for example, an air knife provides a jet of air which assists in locating the sheet on the tray surface. Also known, registration mechanisms require delivery of sheets to the mechanism from only one side, and such can limit the use of the mechanisms to specific kinds of apparatus.

U.S. Pat. No. 5,031,894 and U.S. Pat. No. 5,080,345, which have been assigned to the assignee of the present application, disclose a mechanism which registers a sheet of film and advances it toward an imaging station. A registration member is located along a surface that receives the sheet, and the member is engageable by an edge of the sheet for registering and guiding the sheet toward the station. An urging guide located along another portion of the surface is skewed relative to the registration member and spaced from it so that the end portions of the guide and registration member nearest the station are spaced apart sufficiently to enable the sheet to lie flat on the surface while other portions thereof are sufficiently close together to prevent the sheet from lying flat on the surface. The guide projects above the surface and is tilted away from the registration member so that the guide imparts a component of force onto a sheet resting thereon which urges the sheet toward the registration member. Both of these references discloses means for accommodating sheets of various sizes. In U.S. Pat. No. 5,031,894, movable guides pivot between a lowered position wherein they are recessed in the surface of the platen, and a raised position above the surface. When in the raised position, the movable guides are parallel to the urging guide and enable smaller sheets to be urged toward the registration member, and when in the lowered position they are substantially in the plane of the platen. This reference suggests the use of solenoids in order to raise or lower the guides. Solenoids have limited force and stroke capabilities which require the mechanism to be designed with balancing springs. Additionally, such systems are subject to frictional variations from machine to machine and, with time, such variations can cause a delicately balanced system to not operate. U.S. Pat. No. 5,080,345 pivots each guide about an axis below the platen which is perpendicular to the guides length. This results in the rear portion of the blade being raised while the front portion remains below the top surface of the platen. Due to this receding height, film sheets that are side loaded tend to have their far edge lay on top of the urging guide and not properly registered.

It is an object of the invention to provide a sheet registration mechanism which utilizes the force of gravity for locating a side edge of sheets of various sizes in the registration mechanism wherein movable guides are reliably moved between raised and lowered positions.

SUMMARY OF THE INVENTION

In accordance with the invention, a mechanism for registering sheets of different sizes relative to a station includes a surface for receiving a sheet, and a registration member located along the surface and extending toward the station for guiding the sheet toward the station. A first urging guide extends along the surface in spaced relation to the registration member. A second urging guide rotates about an axis parallel to the guide and below the platen. When the movable guide is in its raised operational position, it is located between the first guide and the registration member.

The invention and its other objects and advantages will become more apparent in the Detailed Description of the Invention presented below.

DETAILED DESCRIPTION OF THE INVENTION

Figure 1:
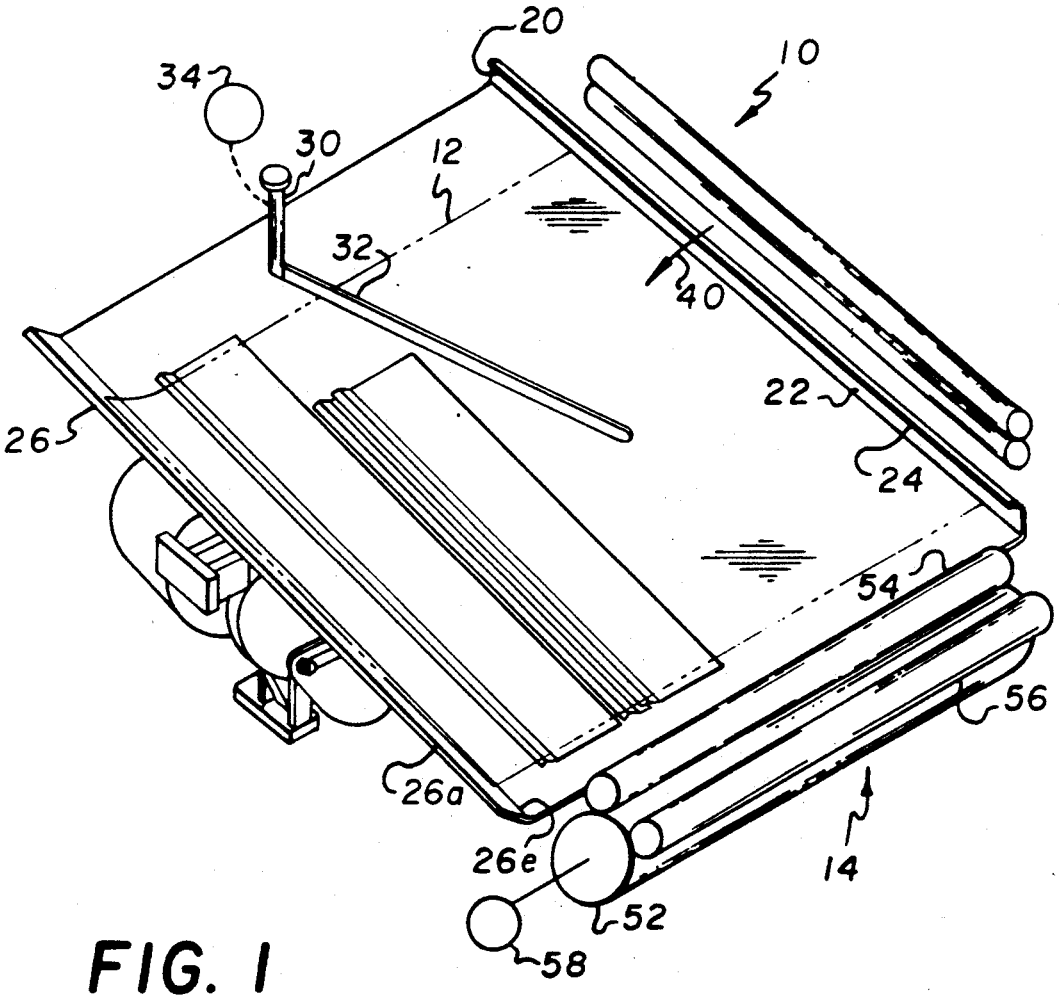
FIG. 1 is a perspective view of a film sheet registration mechanism of the present invention and showing a sheet, in phantom outline, on the mechanism.

A registration mechanism of the invention is generally designated 10. The mechanism receives a sheet 12 and registers the sheet before the sheet is advanced to a station, such as an imaging station 14. The sheet 12 can be any of several different sizes, as explained later. The registration mechanism includes a platen 16 having a flat upper surface on which the sheet 12 is received. Preferably, the surface of platen 16 is located in a substantially horizontal plane. Also, the platen 16 is substantially rectangular in shape and slightly longer and wider than the dimensions of sheets 12 that are to be received by the registration mechanism.

A registration guide 20 is located along one side edge of the platen 16 and extends toward the station 14. Guide 20 has a vertical inner surface 22 that is substantially perpendicular to the upper surface of the platen 16. Sheets advanced along the platen engage surface 22 of the guide and are registered by surface 22 before entry into the station 14. Guide 20 has an upper edge portion 24 inclined inwardly toward the platen 16 so that a sheet being fed into the registration mechanism can be easily directed onto the platen 16.

Figure 2:
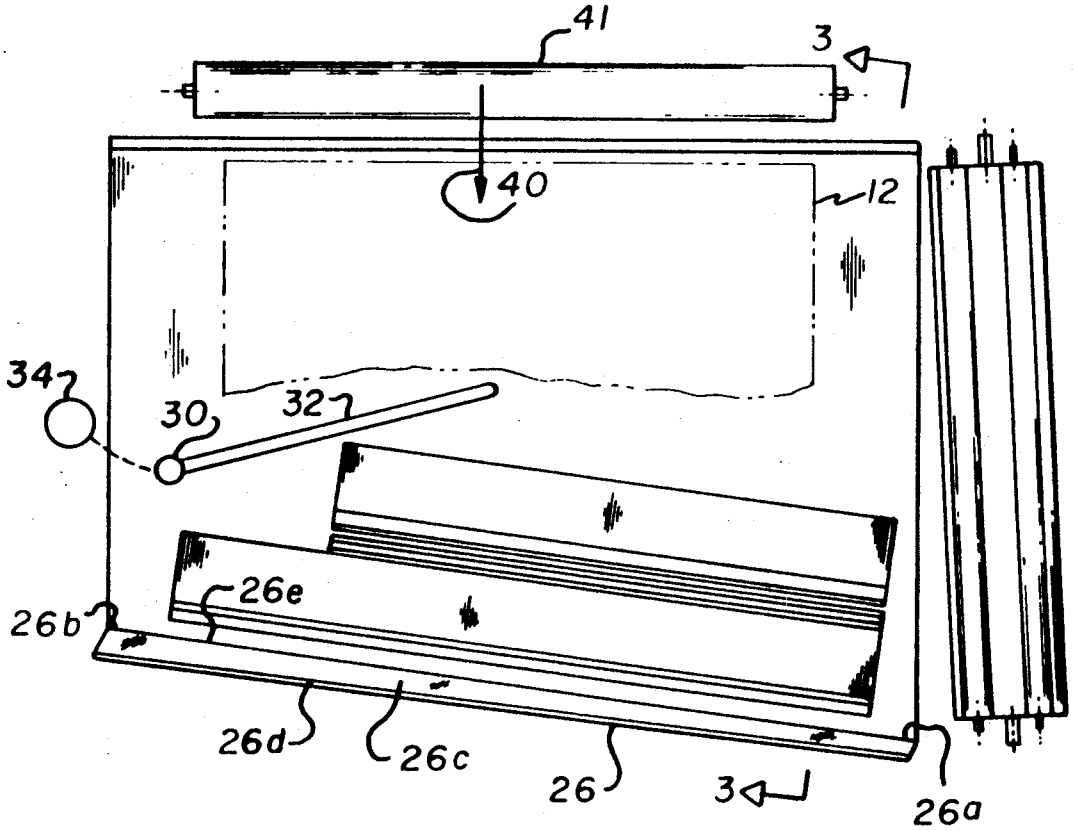
FIG. 2 is a top plan view of a registration mechanism shown in FIG. 1, with a sheet, partially broken away, being in an initial position spaced from an imaging station.

A first urging guide 26 also extends along the upper surface of platen 16 and is effective to urge a sheet on platen 16 toward surface 22 of guide 20. Guide 26 is spaced from the registration guide 20 and also is skewed relative to the guide 20 as best illustrated by FIG. 2. Guide 26 can be skewed at an angle of about 2½ degrees, for example. Guide 26 is located so that the end 26*a* of the guide 20 nearest to the station 14 is spaced a greater distance from surface 22 of the guide 20 than the end 26*b* of guide 26. The distance between end 26*a* of guide 26 and the surface 22 is related to the width of the sheet 12 to be registered and, more specifically, the distance between the end portions of guides 26 and 20 nearest the station 14 is sufficient to enable the portion of the sheet therebetween to lie flat on the upper surface of the platen 16 before entering station 14. On the other hand, the end portion 26*b* of guide 26 is close enough to the surface 22 to prevent the sheet from lying flat on the surface in this area of the mechanism. Thus, the portions of the sheet located on the left end portion of platen 16, as viewed in the drawings, are supported by guide 26.

Urging guide 26 is not only skewed relative to the registration guide 20, but it is also tilted away from the surface 22 of the guide 20. Thus, the surface 26*c* of guide 26 which faces the surface 22 of guide 20 also faces upwardly and extends above the surface of the platen 16. Due to the tilting of the guide 26, the upper edge 26*d* of guide 26 is further from the surface 22 of guide 20 than is the lower edge 26*e* of guide 26. When a film sheet is delivered to the registration mechanism, gravity urges the sheet against guide 26 and the skewed and tilting arrangement of guide 26 causes the guide to impart a lateral component of force onto the sheet 12. This resulting force moves and then holds the side edge of the film sheet against the surface 22 of the registration guide 20 to register the sheet for delivering to station 14. In addition, the spacing between the end 26*a* of the guide and the surface 22 enables the leading edge portion of the sheet to lie flat on the surface of the platen 16 prior to the time it enters the station 14.

Means are provided for moving a sheet 12 toward station 14. More specifically, the moving means illustrated in the drawings comprises a pusher rod 30 which projects upwardly through a slot 32 in platen 16 by a distance sufficient to engage the trailing edge of the sheet 12 on the platen 16. Slot 32 extends from a position adjacent the left edge of the platen 16 toward station 14 by a distance that will permit movement of the leading edge of a sheet into a drive at station 14. Slot 32 is inclined toward the surface 22 of guide 20. By way of example, the slot 32 can be inclined at an angle of about 13° with respect to the guide surface 22.

The slot 32 and rod 30 are located relative to the length of the sheet 12 and relative to station 14 so that when the leading edge of the sheet reaches station 14, the rod 30 is in engagement with the central portion of the trailing edge of sheet 12. For example, for sheets 11" wide, rod 30 can be about 6"–7" from guide 20 when the rod 30 is in its FIG. 2 position, and about 5"–6" from guide 20 when the leading edge of the sheet 12 reaches station 14. The slot 32 can be parallel to surface 22 if sheets of only one width are to be handled, but preferably is inclined when sheets of a plurality of widths are to be handled, as described later.

The pusher rod 30 is driven toward and away from the station 14 by a drive mechanism, shown diagrammatically at 34 in FIGS. 1 and 2. For example, the drive 34 can comprise a belt under platen 16 that is attached to the rod 30 with the belt being trained around a pair of rollers and driven by a reversible motor so that the rod 30 is moved first toward the station 14 and then away from the station 14 under control of a suitable machine control mechanism.

Sheets can be delivered to the platen 16 of the registration mechanism in any suitable manner. In the particular embodiment illustrated, sheets are fed on to the platen 16 over registration guide 20 by a pair of feed roller 41 as indicated by arrow 40 as best seen by reference to FIGS. 1, 2 and 3.

Station 14, as illustrated in the drawings, comprises a scanning station where an image can be formed on a sheet 12 of unexposed film such as x-ray film. Station 14 includes a scan drum or roller 52 and a pair of pinch/exit rollers 54,56. Roller 52 is driven from a suitable drive mechanism shown diagrammatically at 58 in FIG. 1. Rollers 54,56 both contact the surface of roller 52. Rollers 54,56 are spaced from each other and are effective to hold the portion of a sheet 12 located between the nips formed by rollers 52,54 and rollers 52,56 firmly against the surface of the larger roller 52. The image to be formed on the sheet can be projected onto the film through the narrow space between rollers 54,56.

A sheet of film 12 to be registered and delivered to station 14 is fed to the registration mechanism 10 by feed rollers 41. The sheet is delivered onto the platen 16 with the trailing edge thereof spaced from rod 30 and with the leading edge thereof spaced from the station 14. The force of gravity pulls the sheet toward the surface of platen 16 and against the skewed, tilted surface 26c of guide 26 which produces a lateral component of force that urges the sheet toward the surface 22 of the registration guide. Then the rod 30 is driven to the station 14 as viewed in FIGS. 1 and 2 and toward the guide 22, thereby urging the sheet toward guide 22 and simultaneously moving it into the station 14.

As the leading edge of the sheet enters station 14, it enters the nip between rollers 52,54 and then the nip between rollers 52,56. The rollers 52,54,56 drive the sheet at a velocity that exceeds the velocity imparted to the sheet by rod 30 so that the sheet is pulled away from the rod and is controlled entirely by the rollers 52,54,56 as it moves through station 14. This enables scanning of the sheet film to take place with no influence from the rod 30.

A film sheet registration mechanism as described above is disclosed in U.S. Pat. No. 5,080,345, mentioned previously. As recognized in such patent, at times it is desirable to use such a registration mechanism for feeding film sheets of widely different dimensions to a station 14. For example, sheets of x-ray film are commonly available in sizes of 8×10 inches, 11×14 inches, 14 by 14 inches, and 14×17 inches. When the registration mechanism is to handle film sheets of such widely varying dimensions, the urging guide 26 is spaced from surface 22 of the registration guide by a distance such that it is capable of handling the widest sheet to be accommodated on the registration mechanism, such as sheets 14" wide. For smaller sheets, such related patent application discloses additional urging guides which pivot between a lowered position in recesses in the platen and raised positions above the platen surface and parallel to the guide 26 wherein they can handle smaller sheets. In accordance with the present invention, an improved mechanism is provided for handling sheets of different sizes.

Referring now to FIGS. 1–4 and 6, a second urging guide 60 is provided for accommodating sheets of a narrower width than the widest sheets to be handled by the mechanism. More specifically, for the range of sizes mentioned above, urging guide 60 is designed to handling sheets that are 11 inches wide. Guide 60 comprises a generally flat engagement section 62 and a lower mounting section 64. The engagement section 62 is designed to lie substantially flat on top of platen 16 when in the non-operational mode so as to not interfere with other size sheets being processed by the mechanism. The lower mounting section 64 extends below platen 16. In the particular embodiment illustrated lower mounting section 64 is integrally formed with engagement section 62 and extends from the lower end of engagement 60 through an elongated opening 66 provided in platen 16. Lower mounting section 64 is provided with a pair of side mounting projections 68, one being disposed at each of the lateral ends of mounting section 64. The mounting projections 68 are pivotally mounted about axially spaced pivots 70 disposed beneath platen 16. In the particular embodiment illustrated, the pivots 70 extend from a pair of downwardly extending projections 72 secured to the bottom of platen 16.

Figure 3:
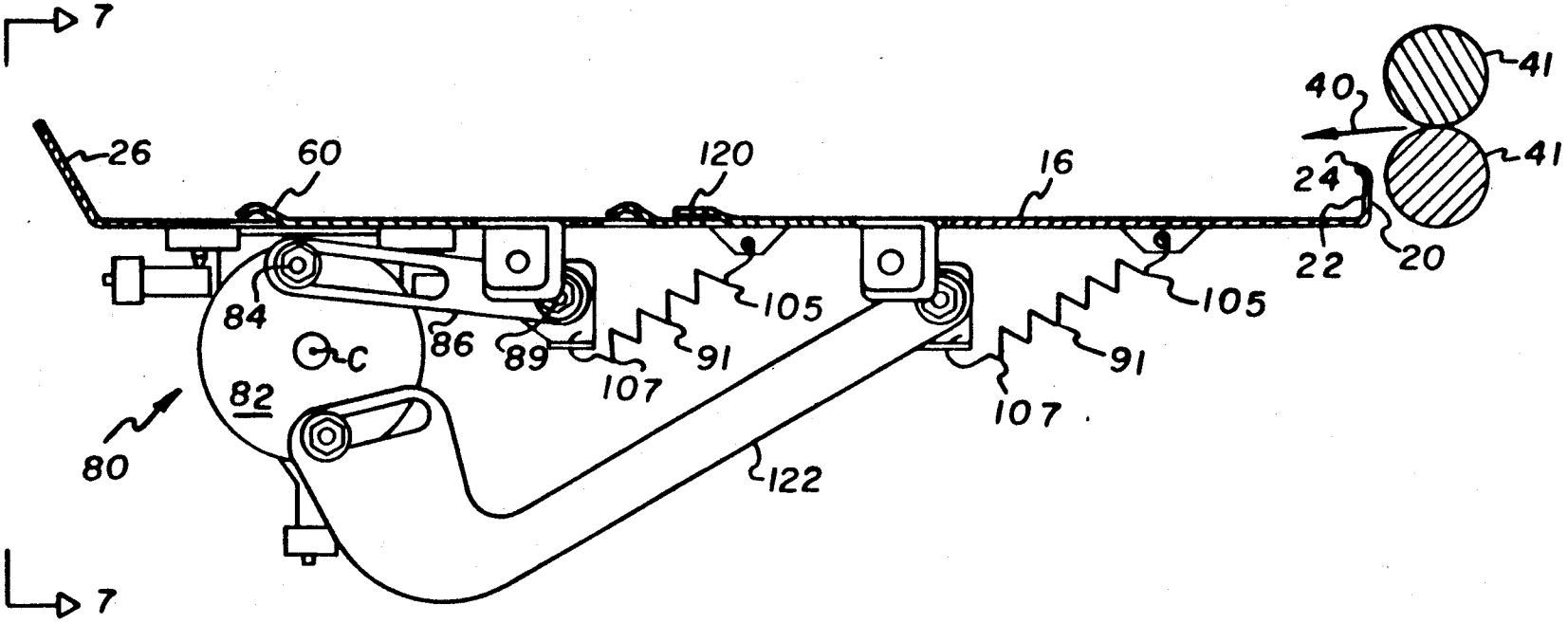
FIG. 3 is a side cross sectional view of the registration mechanism as taken along line 3—3 of FIG. 2 illustrating the movable guides in the non-operative position.
Figure 5:
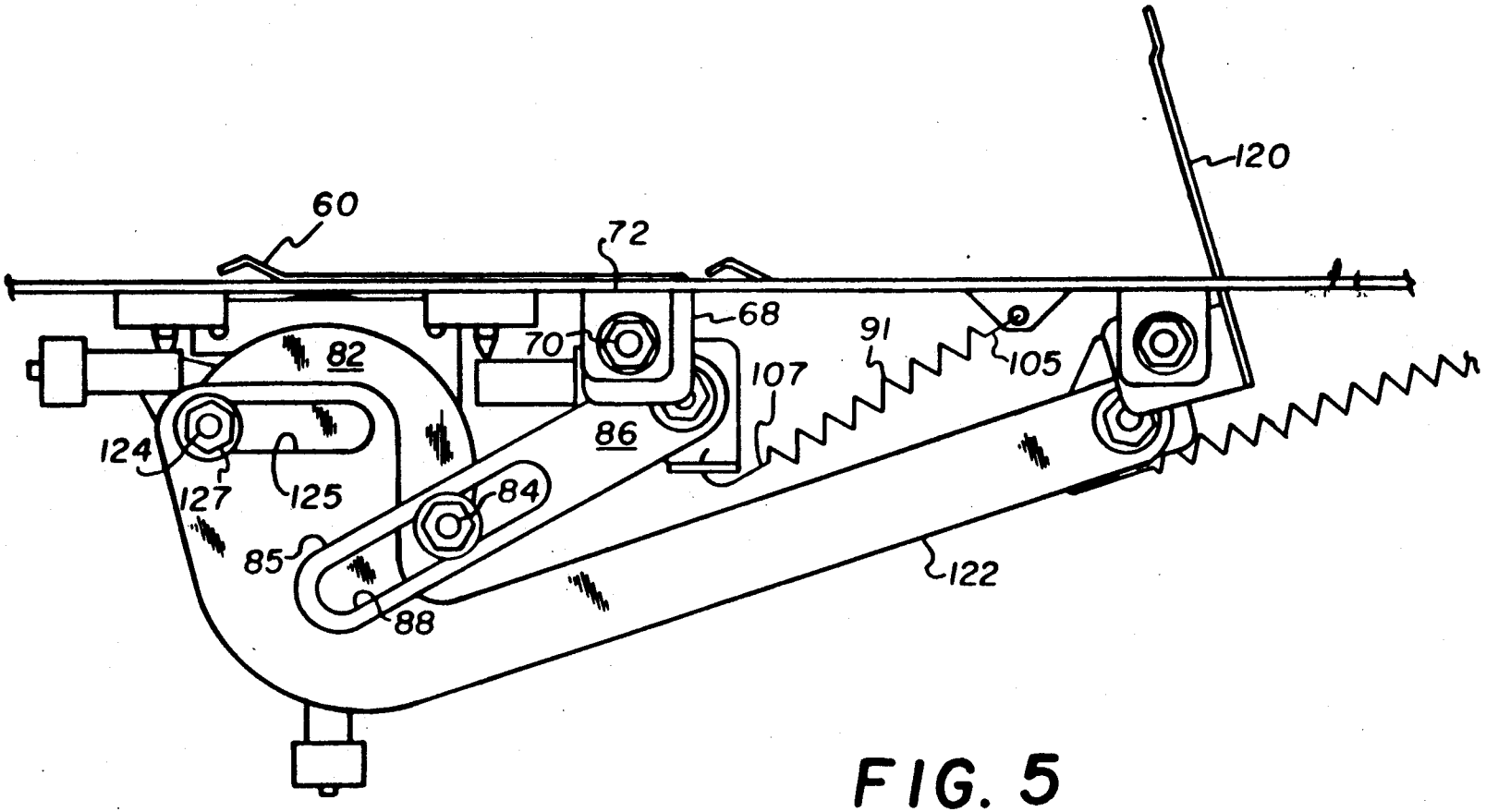
FIG. 5 is an enlarged partial side cross sectional view similar to FIG. 3 illustrating one of the movable guides in the operative position.
Figure 6:
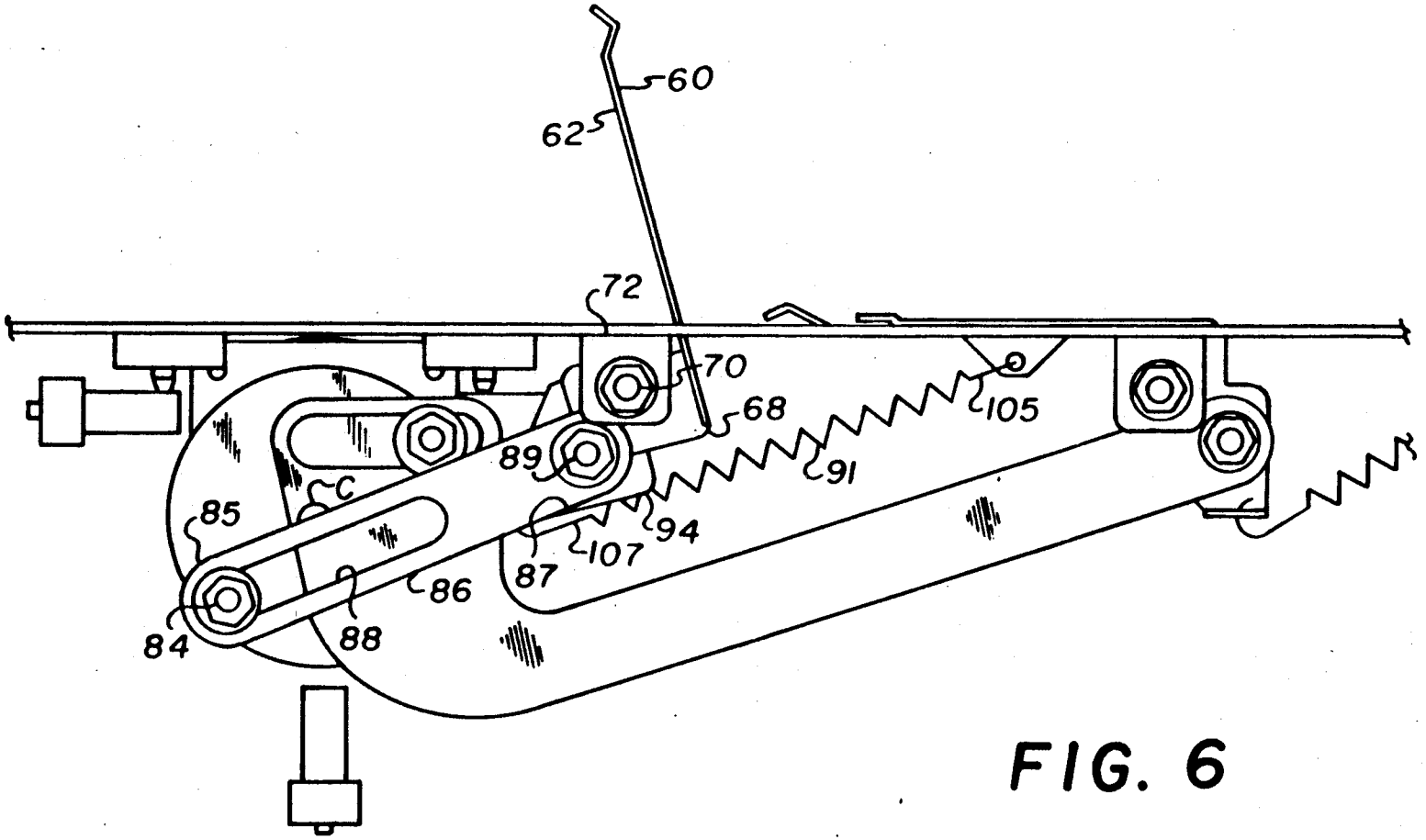
FIG. 6 is a partial side cross sectional view similar to FIG. 5 illustrating the second movable guide in the operative position.
Figure 7:
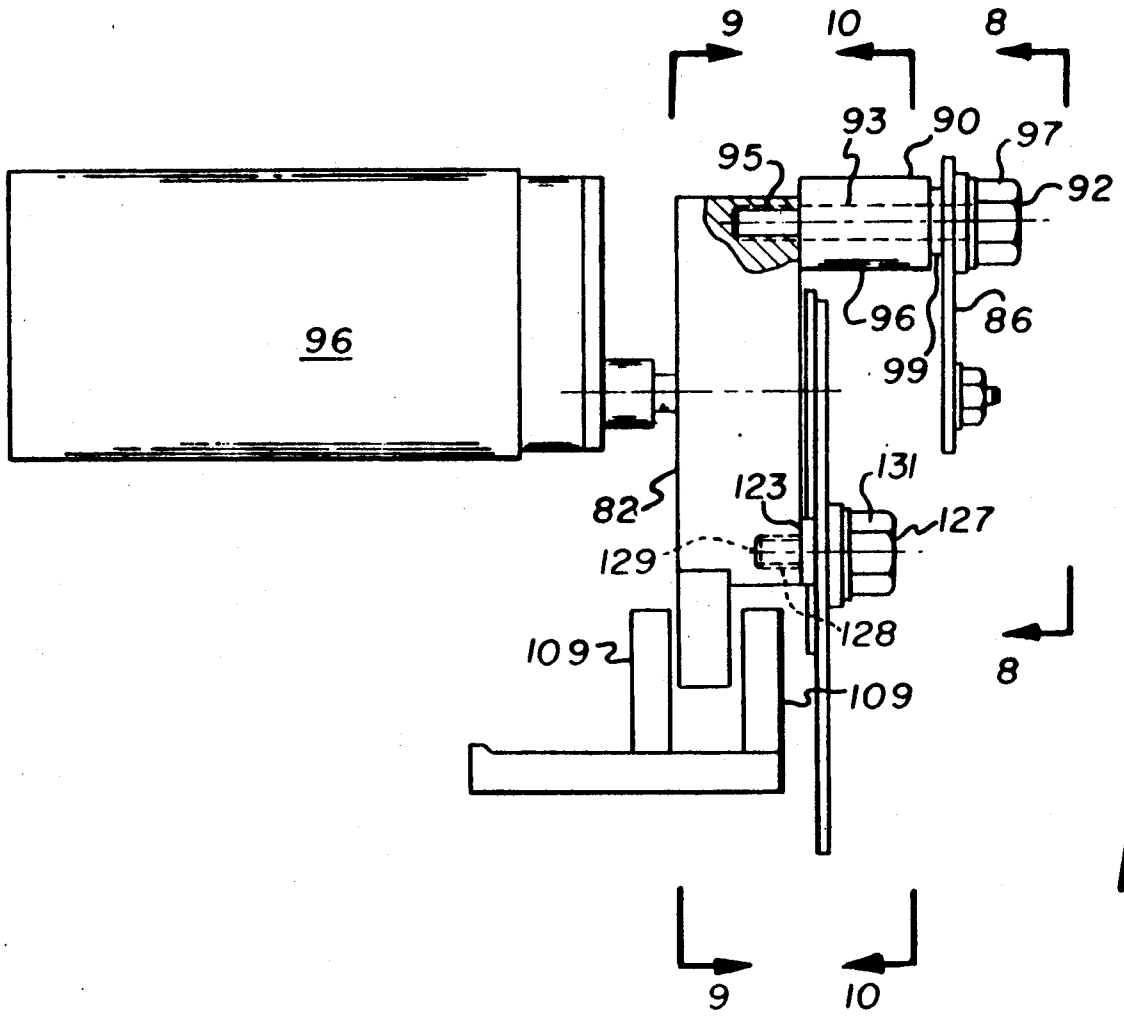
FIG. 7 is a end elevational view of a portion of the mechanism of the present invention as taken along line 7—7 of FIG. 3.
Figure 12:
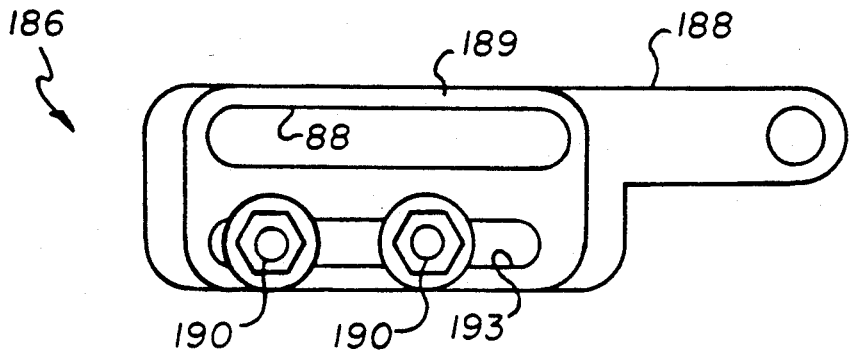
FIG. 12 is a front elevational view of a modified link assembly used to move the guide illustrated in FIG. 5.

An over the center mechanism 80 is provided for rotating guide 60 about an axis which is substantially parallel to its length between a first non-operative position, as illustrated in FIGS. 3 and 5, and an operative position as illustrated in FIG. 6. Mechanism 80 is mounted beneath the platen 16, and includes a crank 82 having a first drive pin 84 designed to be rotated about the center C of crank 82. A link 86 is provided for connecting crank 82 to guide 60. The link 86 :s slideably mounted to drive pin 84 through a slot 88 provided at end 85 of the link 86. In the particular embodiment illustrated drive pin 84 comprises a screw 92 (as shown in FIGS. 7 & 12) having a threaded shank 93 which extends through slot 88 and is threaded into a corresponding threaded opening 95 in crank 82. A spacer 96 is provided for spacing link 86 from crank 82, as best illustrated by FIG. 7. Screw 92 has head 97 which retains link 86 in position with respect to crank 82. A bushing 99 is provided about the shank 93 so that it will not directly contact slot 88. It is to be understood that the link 86 may be slideably mounted to crank 82 in any desired manner. The link 86, at its other end 87, is rotatably mounted to a pin 89 through an opening provide in end 87. The pin 89 is secured to a mounting bracket 94 which in turn is secured to mounting section 64 of guide 60. The crank 82 may be rotated in either direction by reversible motor 96 which is secured to the axis of the crank 82. A spring 91 having a pair of ends 105,107 is provided for applying a biasing force against guide 60 so as to maintain it in one of two locked positioned as is more fully discussed later herein. End 105 of spring 91 is secured to opening 98 in mounting bracket 94, and the other end 107 is secured to the bottom of platen 16.

Figure 8B:
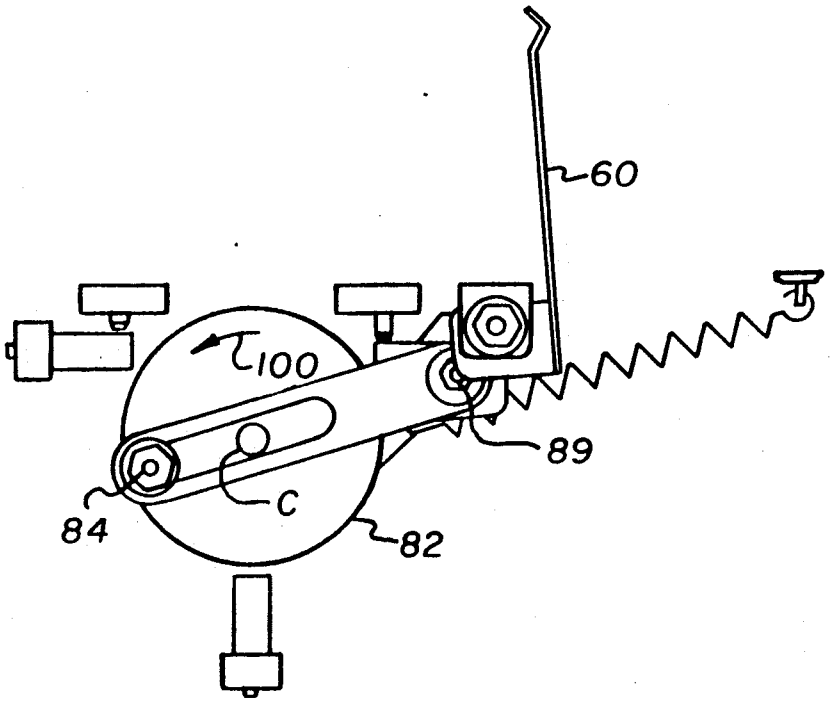
FIGS. 8*a*–8*d* are side elevational views of the movable guide illustrated in FIG. 5 as taken along line 8—8 of FIG. 7 showing the progressive movement of one of the movable guides from its non-operational position, as shown in FIG. 8*a*, to its fully operational position, as illustrated in FIG. 8*d*.
Figure 8A:
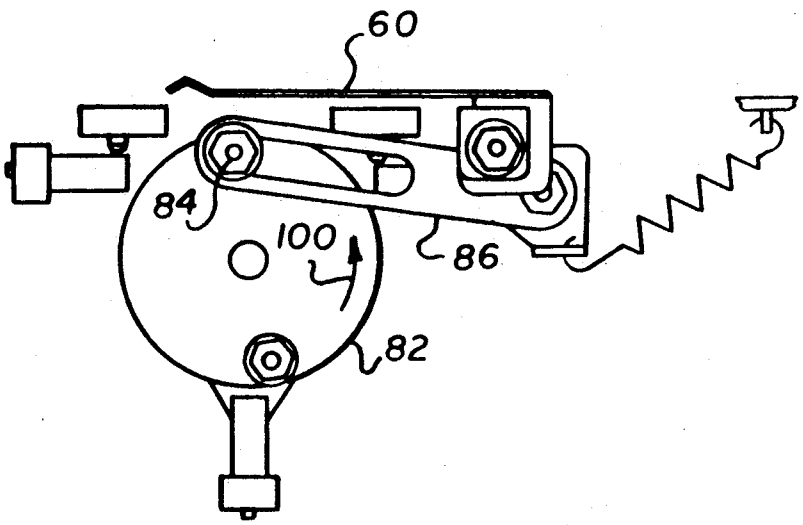
Figure 8D:
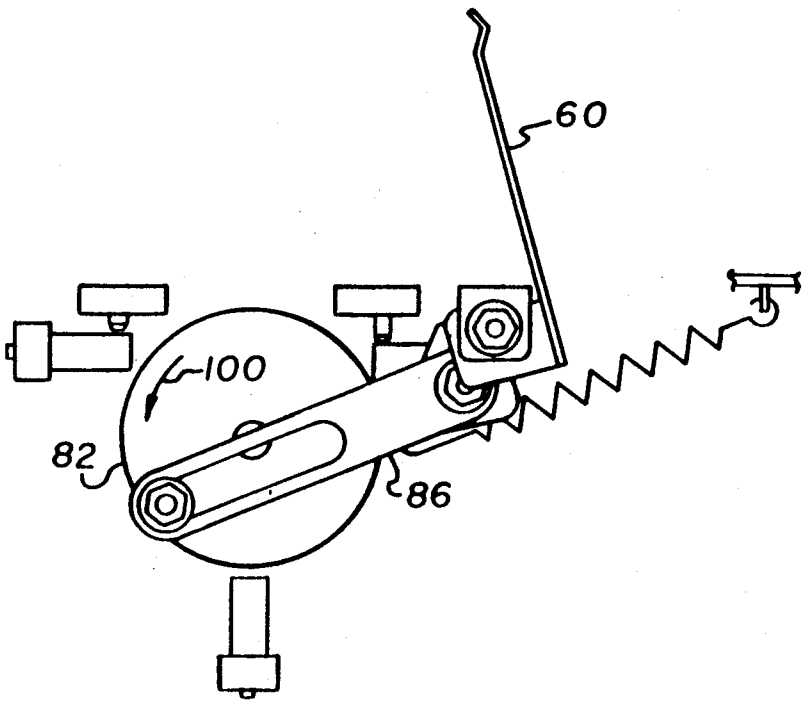

In order to more fully understand the present invention, the operation of the device as it relates to movement of guide 60 will now be discussed in detail. Referring to FIGS. 8a–8d, there is illustrated, in successive steps, the motion of the guide 60 in response to the operation of mechanism 80 rotating crank 82 which causes the guide to move between its non-operative position, as illustrated in FIG. 8a, and its fully operational position as illustrated in FIG. 8d. Referring to FIG. 8a, guide 60 is illustrated in the non-operative position wherein the engagement section 62 is lying substantially flat on the platen 16. In this position the spring 98 applies a biasing force which locks the engagement section 62 against the top of platen 16. When it is desired to place the guide 60 in the operational position, as shown by FIG. 8d, the motor 96 is activated so that the crank 82 is rotated in the counterclockwise direction as illustrated by arrow 100. As the crank 82 is rotated it will pass the "top dead center" position as shown in FIG. 8b, that is, the position at which the drive pin 84, the center C of crank 82, and pin 89 are in direct alignment. The crank 82 is rotated by motor 96 until it reaches the position illustrated by FIG. 8c. In this position engagement section 62 is positioned at an angle $\alpha$ with respect to platen 16 of approximately 80°. The motor 96 is turned off in response to a signal generated as is later discussed herein. The spring 98 applies a biasing force to mounting bracket 94 of guide 60. However, since the link 86 has been rotated passed the "top dead center" position, this results in the guide 60 being moved to the position illustrated in FIG. 8d and is locked in this position. In this position, engagement section 62 forms an angle $\alpha$ of about 75° with the platen 16. From the foregoing it can be seen that guide 60 whether it is in the non-operative position illustrated in FIG. 8*a*, or in a fully operative position, as illustrated in FIG. 8*d*, a biasing force is applied by the spring 91 so as to lock the guide 60 in its respective position.

Referring to FIGS. 9*a*-9*d*, there is illustrated a series of successive cross-sectional views of the position of the crank 82 and guide 60, as taken along line 9—9 of FIG. 7 which correspond to the positions illustrated in FIG. 8*a*-8*d*. FIGS. 9*a*-9*d* show the other side of crank 82 and guide 60. As is more clearly seen by FIGS. 9*a*-9*d*, crank 82 is provided with a flag 102 which is used to monitor the rotational position of the crank 82, and provides means for preventing further rotation of the crank 82. Sensors 104,106,108 are provided to monitor the position of the flag 102 of crank 82. In the particular embodiment illustrated, sensors 104,106,108 each comprise a light sensor having a pair of spaced arms 109 (see FIG. 7). The sensors are located such that the flag 102 must pass between arms 109 of the senors. An appropriate signal is generated by the sensor when flag 102 passes between the arms 109 which is sent to an appropriate control unit, such as a computer, for further processing as is well known in the art. A pair of stops 110,112 are provided to prevent rotation of the crank 82 past a predetermined point as will be discussed later herein.

Figure 8C:
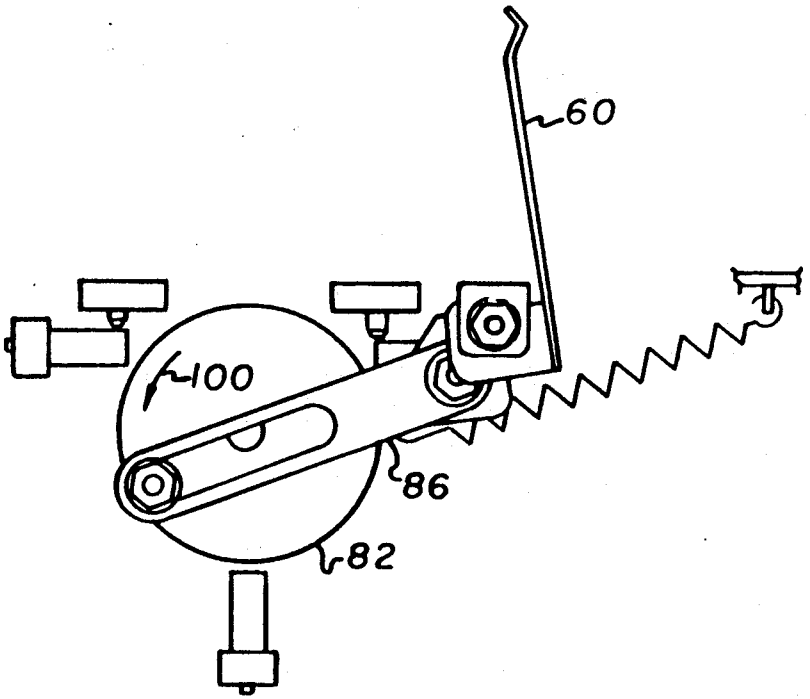
Figure 9A:
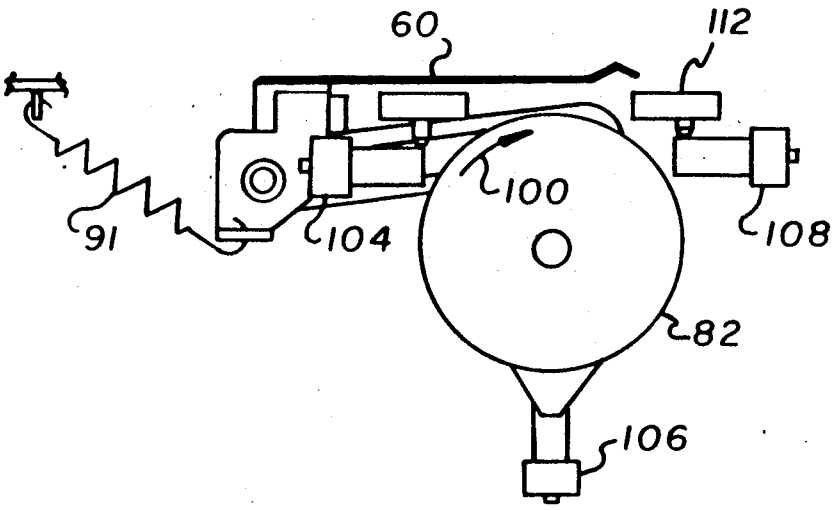
FIGS. 9*a*–9*d* are side elevational views of the mechanisms used to move the movable guide of FIG. 8 as taken along line 9—9 of FIG. 7.
Figure 9B:
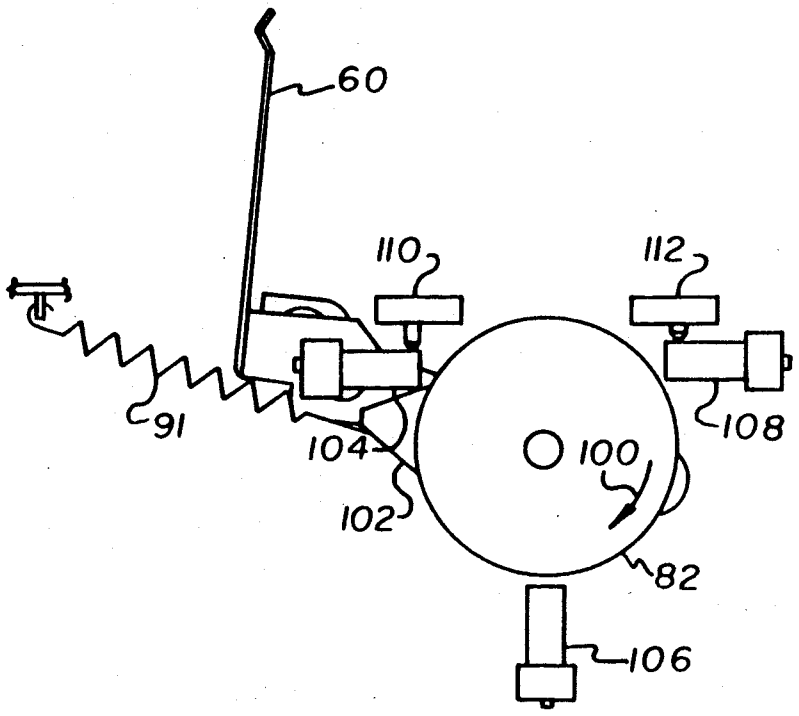
Figure 9C:
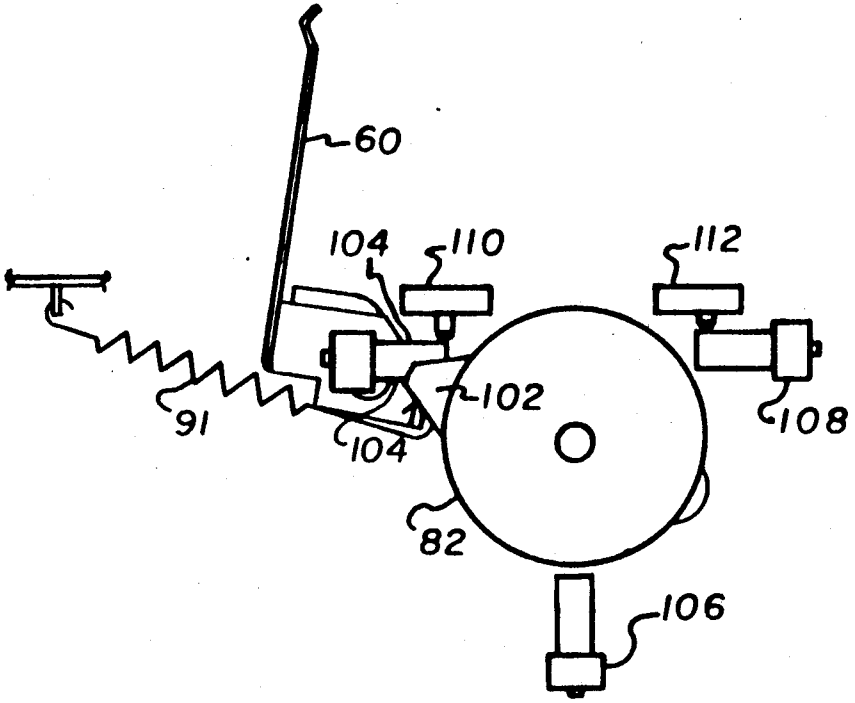
Figure 9D:
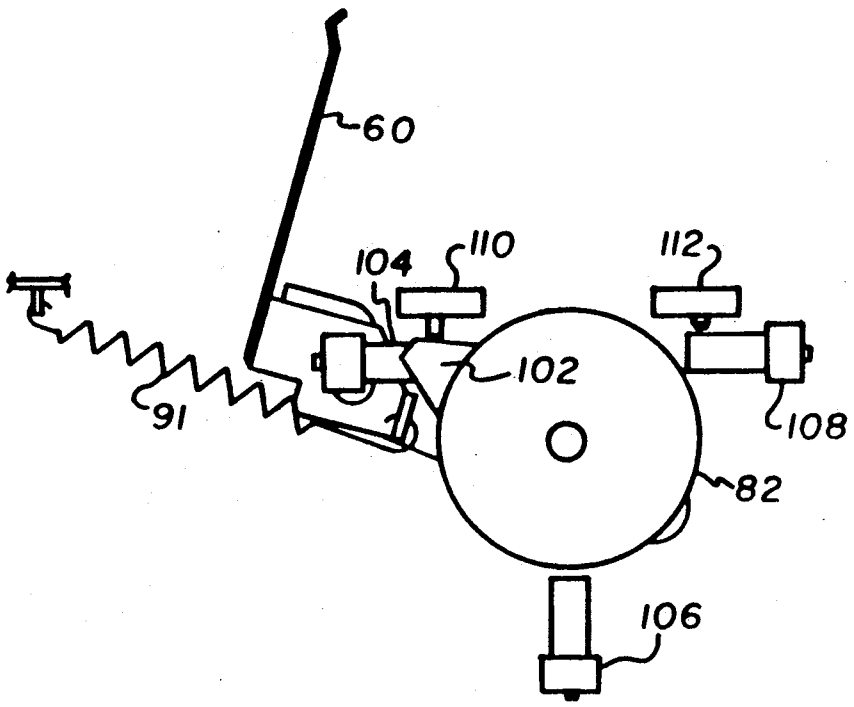

Referring to FIG. 9*a*, crank 82 is shown in the position which results in the guide 60 being positioned in its non-operative mode as illustrated in FIGS. 3, 5 and 8*a*. In this position, sensor 106 senses flag 102 is located between arms 109 and provides an appropriate signal which is sent to the control unit. FIG. 9*b* illustrates the crank 82 when it has been rotated to the "top dead center" position as illustrated in FIG. 8*b*. In this position, the flag 102 is just below sensor 104. Referring to FIG. 9*c*, this illustrates the crank 82 in the same position as illustrated in FIG. 8*c* except as viewed from the other side. The sensor 104 in this position senses the flag 104 and sends a signal to the control unit which turns off the motor 96 driving crank 82. The spring 91 pulls the crank 82 to the position illustrated in FIG. 8*d*. This positions the guide 60 in its fully operational position. In this position, the sensor 104 continues to senses that flag 102. The stop 110 provides means for preventing any further movement of the crank 82. When it is desired to move the guide 60 to its non-operative position, the motor 96 is activated so as to cause the crank 82 to rotate in the opposite direction. This results in the crank 82 returning to the position illustrated in FIGS. 8*a*.

Referring to FIGS. 3,5 and 7, a third urging guide 120 is substantially identical in configuration to guide 60 except that it is shorter in length and is mounted to the platen 16 in a similar manner as guide 60 has been described, like numerals indicating like parts. A second link 122 is provided for moving guide 120 between an operational position and non-operational position in the same manner as guide 60. However, in this configuration, the link 122 is mounted to crank 82 by a second drive pin 124 which is positioned at a point spaced about the circumference of crank 82 from the drive pin 84. The link 122 is slideably mounted to the crank in the same manner as link 86 is mounted to crank 82. That is, drive pin 124 comprises a screw 127 which passes through a elongated slot 125 provided at one end of the link 122. The screw 127 has a threaded shank 128 which engages a threaded opening 129. The screw 127 has a head 131 which is larger in size than the slot 125 in link 122. A bushing 123 is provided around the shank 127 and is located between the link 122 and crank 82. The bushing 123 is smaller than spacer 90 so that there will be no interference between links 86 and 122 as crank 82 is rotated.

Figure 4:
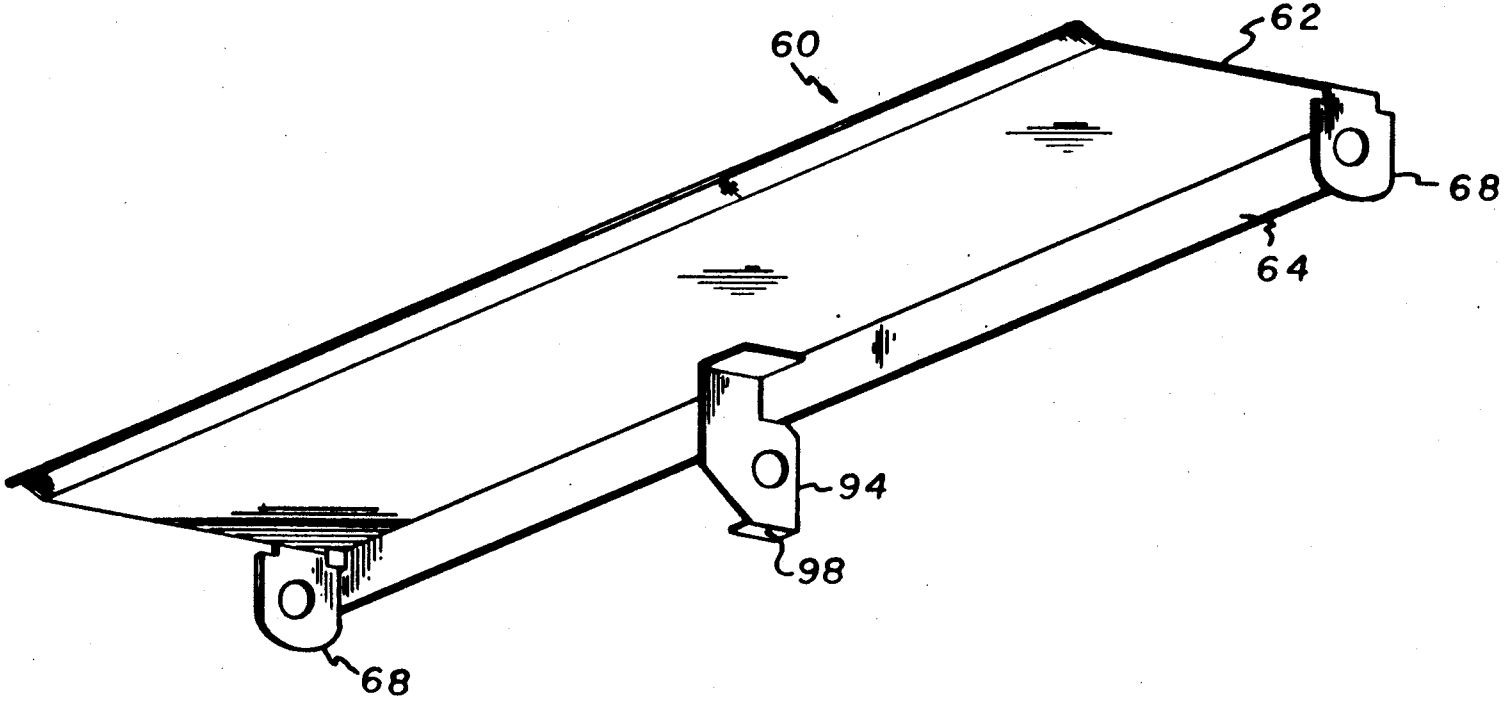
FIG. 4 is a perspective view of a movable guide used in the mechanism of FIG. 1.
Figure 10A:
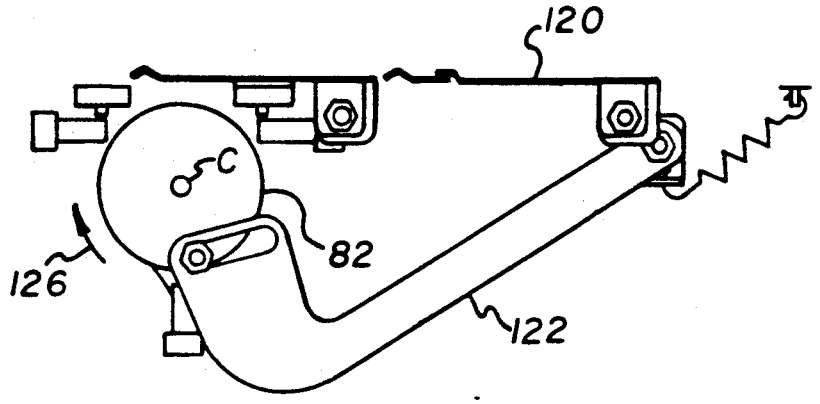
FIGS. 10*a*–10*d* are side elevational views of the mechanism as taken along line 10—10 of FIG. 7 illustrating the progressive movement of a second movable guide from its non-operational position to its final operational position as shown in FIG. 10*d*.
Figure 10B:
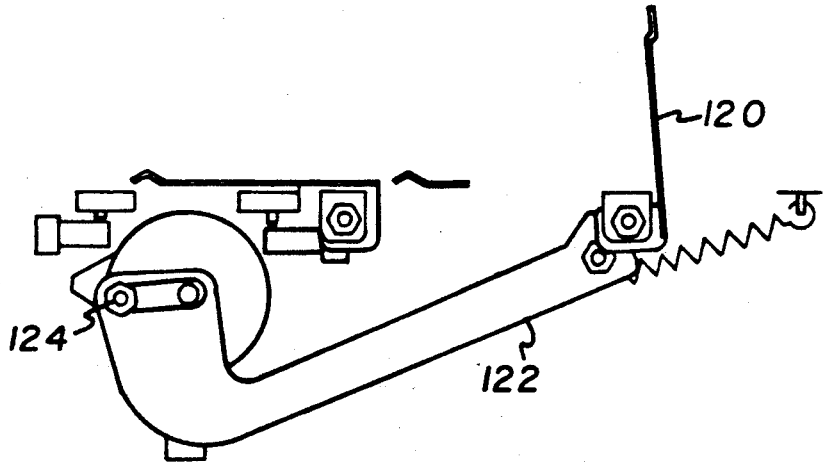
Figure 10C:
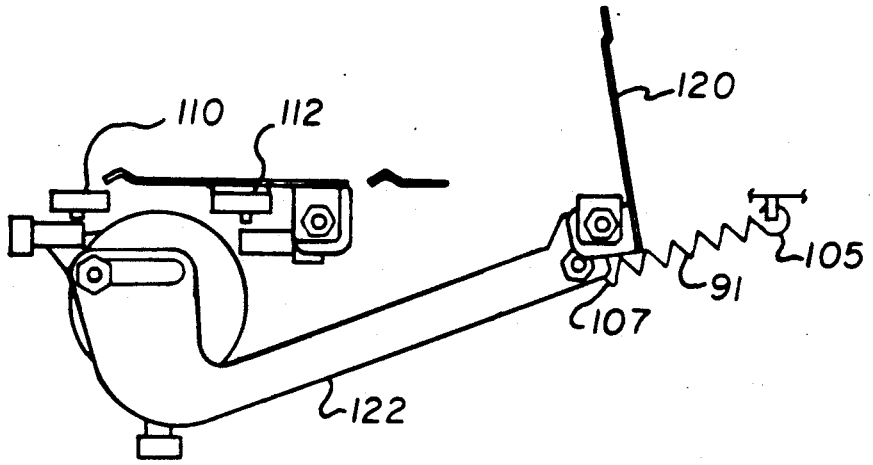
Figure 10D:
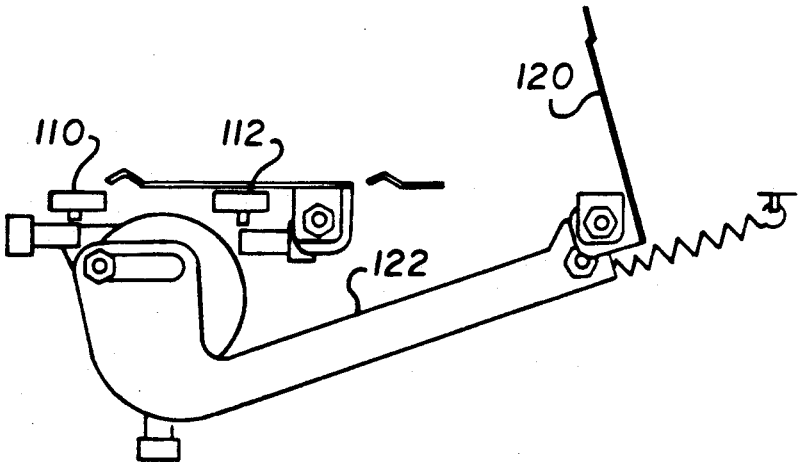
Figure 11A:
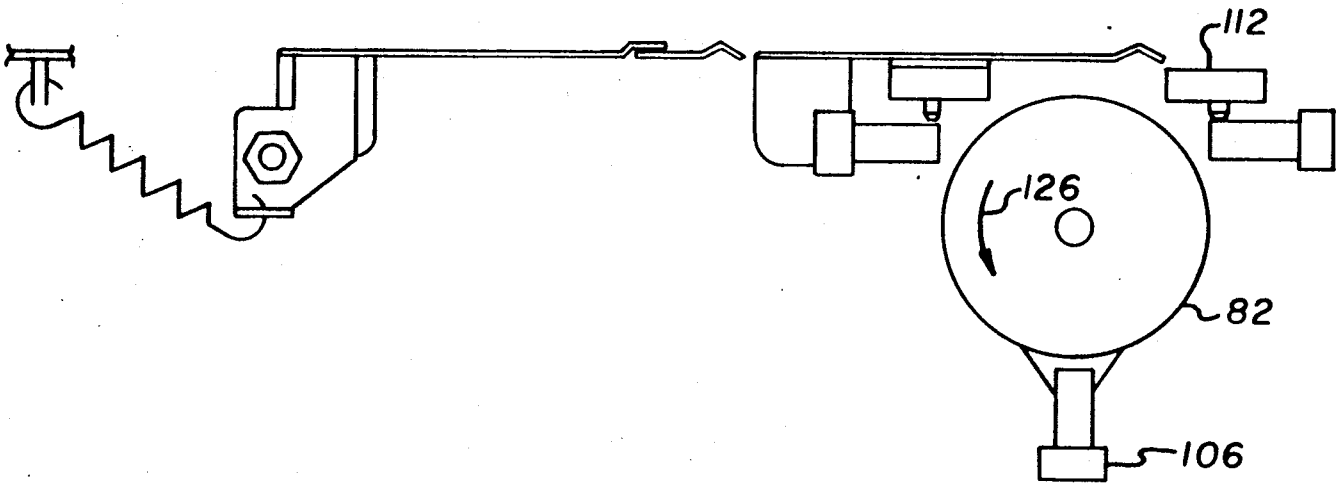
FIGS. 11*a*–11*d* are side elevational views illustrating corresponding positions of the second moving guide of FIGS. 10*a*–10*d* as taken along line 9—9 of FIG. 7.
Figure 11B:
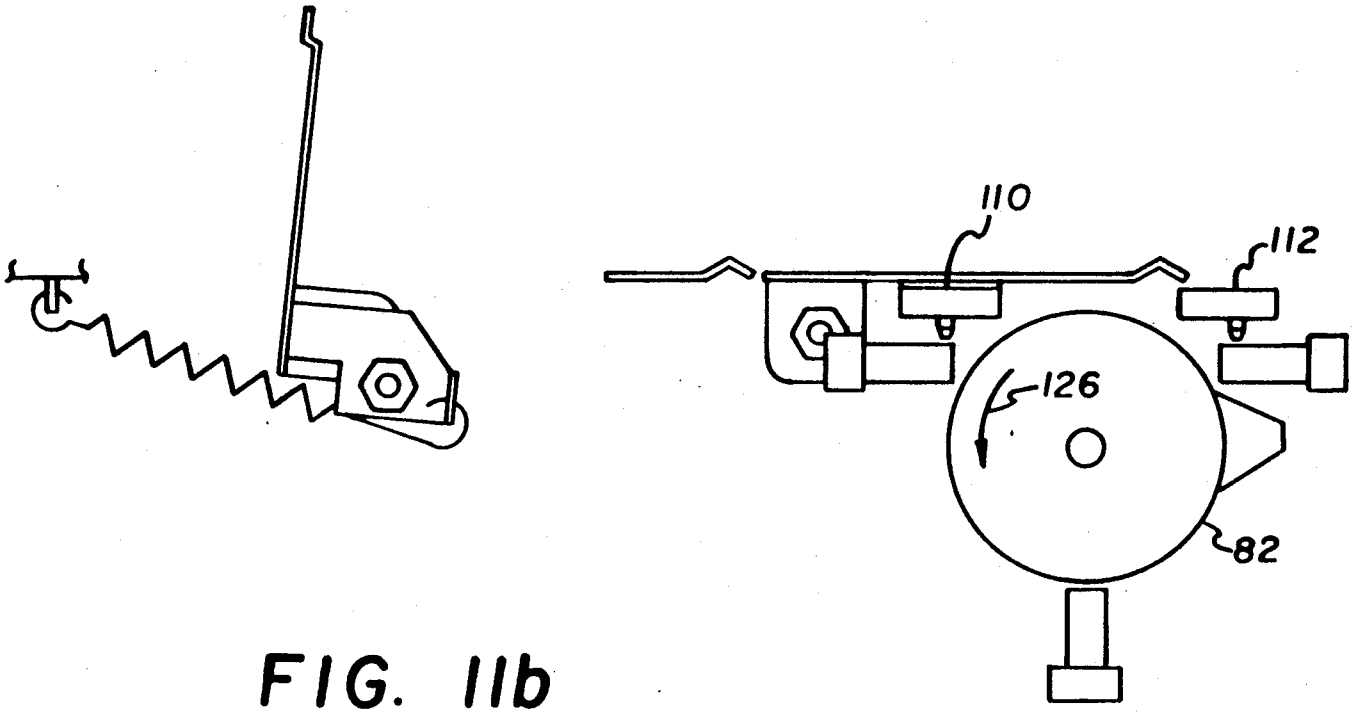
Figure 11C:
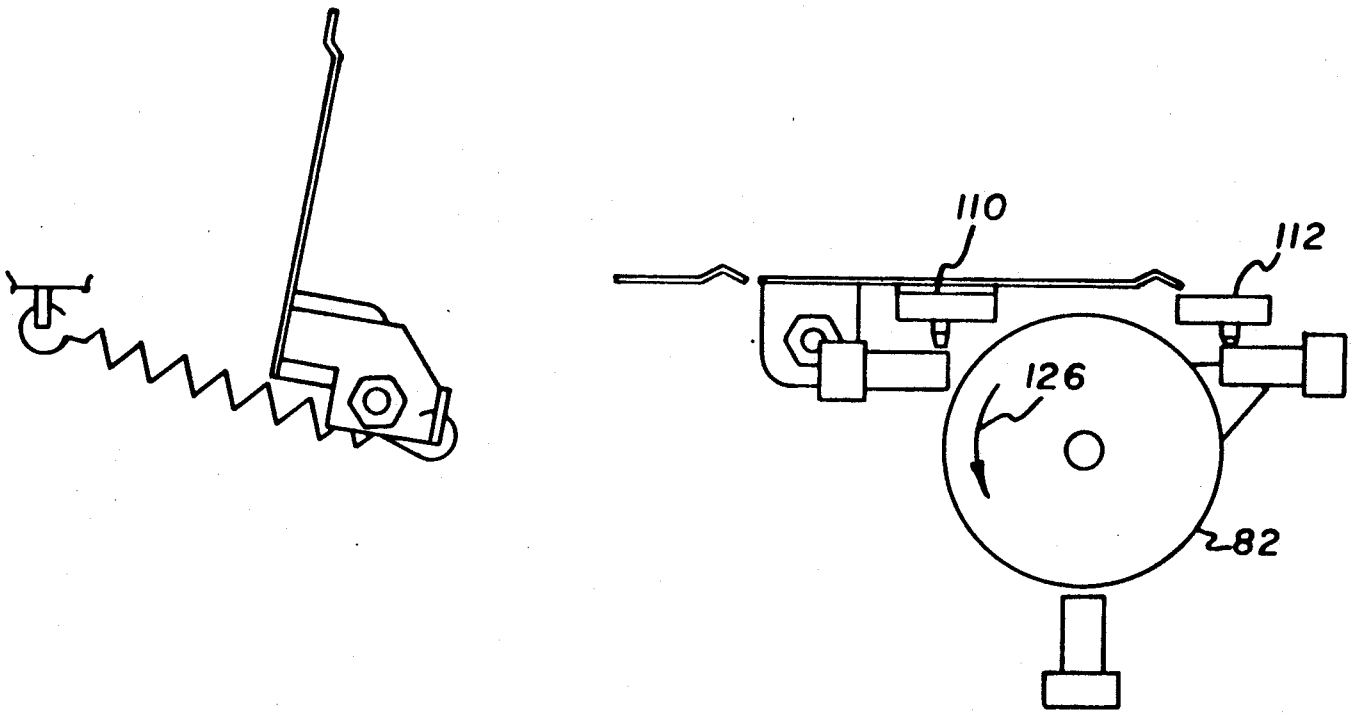
Figure 11D:
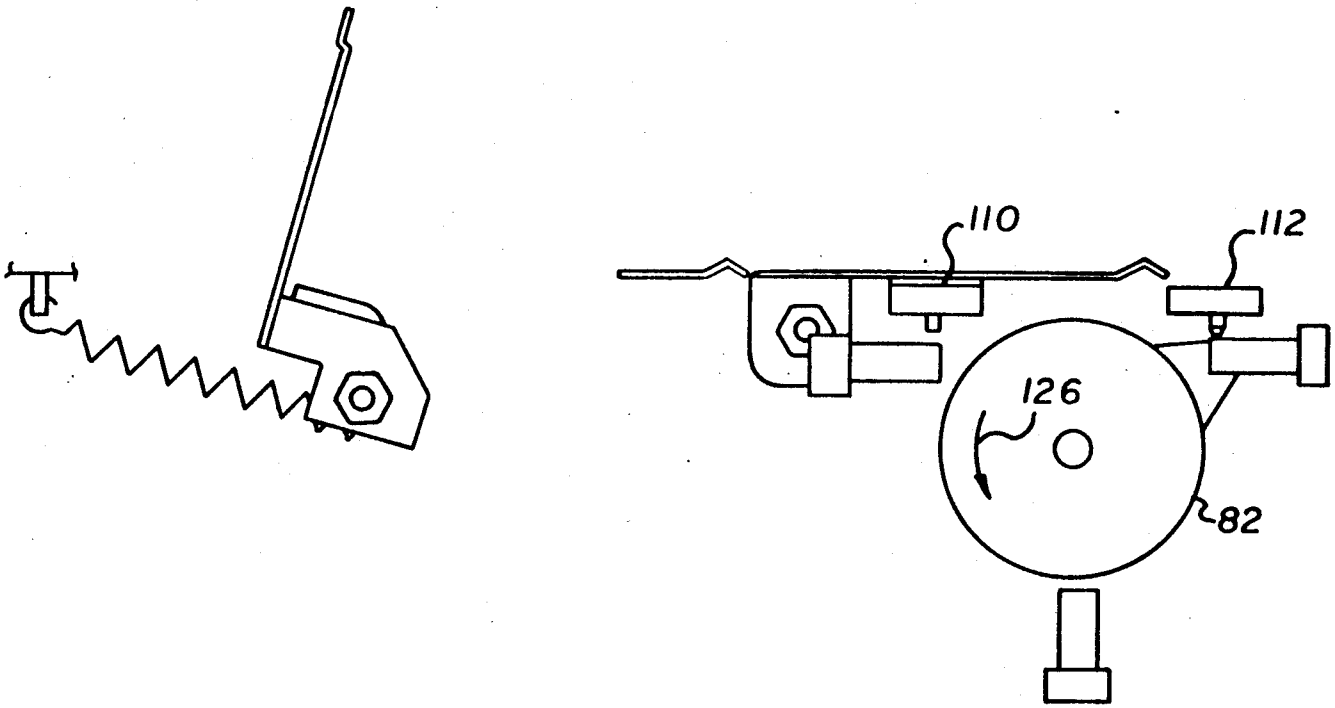

Referring to FIGS. 10*a*-10*d*, there is illustrated the motion of guide 120 as it moves between its normally non-operative position, as illustrated in FIG. 10*a*, to its fully operational position as illustrated in FIG. 10*d*. When it is desired to move guide 120 to its operational position, as illustrated in FIGS. 4 and 10*d*, the crank 82 is rotated in the clockwise direction, as indicated by arrow 126 in FIG. 9*a*. FIG. 10*b* illustrates the link 122 in the top dead center position and FIG. 10*c* illustrates link 122 in the position that the guide 120 forms an angle $\alpha$ of about 80° with respect to the platen 16. FIG. 10*d* illustrates the guide 120 in its fully operational position. In this position, the guide 120 is locked in position by spring 91 in the same manner as guide 60.

Referring to FIGS. 11*a*-11*d*, there is illustrated guide member 120 and associated parts in as taken along line 8—8 of FIG. 6. These figures corresponds to the relative positions illustrated in FIGS. 10*a*-10*d*. In particular, these figures illustrate the position of the crank 82 and flag 102 with respect to sensors 104,106,108 and stops 110,112. As crank 82 is rotated in the direction to cause guide 120 to move to its fully operational position the flag 102 moves by sensor 108, which provides an appropriate signal to control unit for deactivation of motor 96. The stop 112 provides a positive resting point against which the flag 102 may rest. The spring applies a biasing force which causes the flag 102 to be biased against the stop 112.

The slots 88,125 of the links 86,122, respectively, each have a length L1,L2 such that only one of the links will actively engaging the crank 82 at any one time so as to cause its respective guide to move between its operative and non-operative positions. For example, referring to FIG. 5, it can be seen that the link 120 is moved by rotation of crank 82. However, due to the length of the slot 88 in link 86, the guide 60 is not effected by the rotation of the crank 82. The guide 60 is not engaged by crank 82 and thus remains in its non-operational position. Referring to FIG. 6, it can be seen that rotation of the crank 82 in the opposite direction results in the link 86 being moved by drive pin 84 which causes activation of guide 60, whereas the drive pin 124 slides in slot 125 of link 120 leaving guide 120 in its non-operational position. By appropriately selecting the length of the respective links and its position on the crank, the desired amount of movement of guides 60,120 may be controlled.

Figure 13:
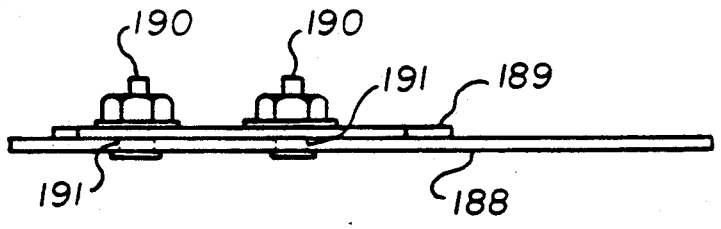
FIG. 13 is a bottom view of the link assembly of FIG. 12.
Figure 14:
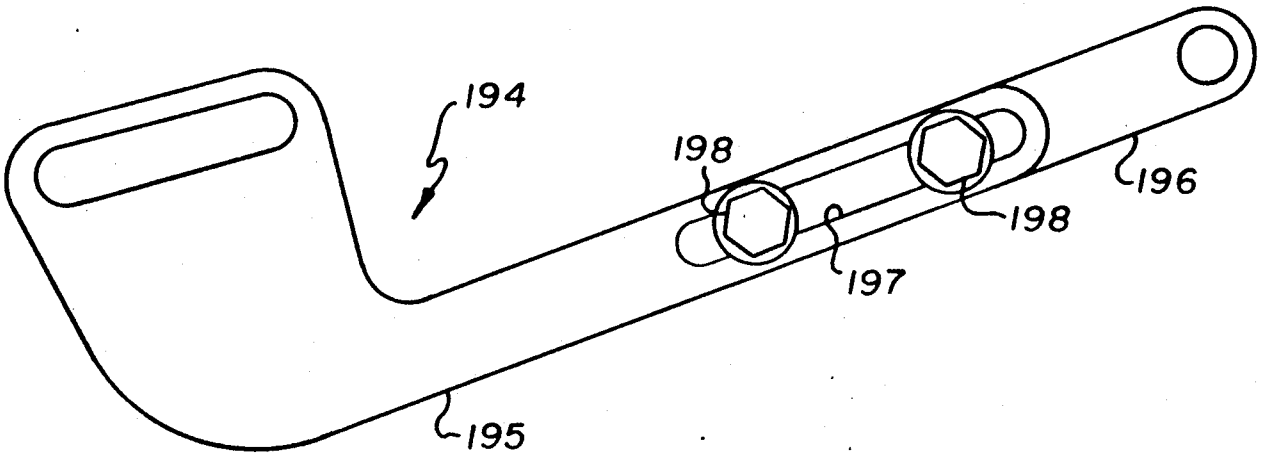
FIG. 14 is a front elevational view of a modified link assembly used to move the movable guide illustrated in FIG. 6.
Figure 15:
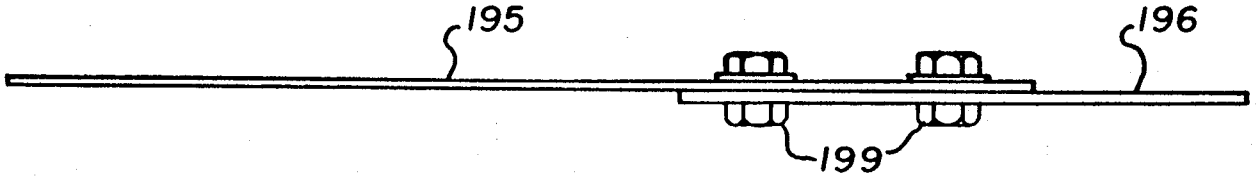
FIG. 15 is a bottom view of the link assembly of FIG. 14.

Applicant has found that it is sometimes difficult to precisely maintain the desired angular movement of the guides. This problem can be simply solved by providing adjustable length links. One manner in which this can be accomplished is by making links in two separate segments which can be adjusted to control the amount of movement of its associated guide. In particular, referring to FIGS. 12 and 13, there is illustrated a modified link 186 which can be substituted for link 86. Basically, link 186 is substantially identical to link 86 except that the positioning of slot 88 may be adjusted. The link 186 comprises a main member 188 and a secondary member 189 which is slideably mounted to member 188 by a pair of screws 190 which extend through a pair of openings 191 provided in member 188 and pass through a slotted opening 193 in member 189. The screws 190 each have fastening means for tightening member 188 against 189 such that the slot 88 in member 188 may be adjusted to provide the desired linkage length. Likewise, referring to FIGS. 14 and 15, a link member 194 is provided to take the place of link member 122. Link member 194 comprises a forward member 195 having a longitudinally slot 197 and a rearward member 196 having a pair of openings through which a pair of screws 198 pass. The members 195, 196 are held together by a pair of nuts 199 which engage screws 198 clamping the members 195, 196 therebetween. The length of link member 194 is easily adjusted by clamping members 195, 196 at the desired position.

Figure 16:
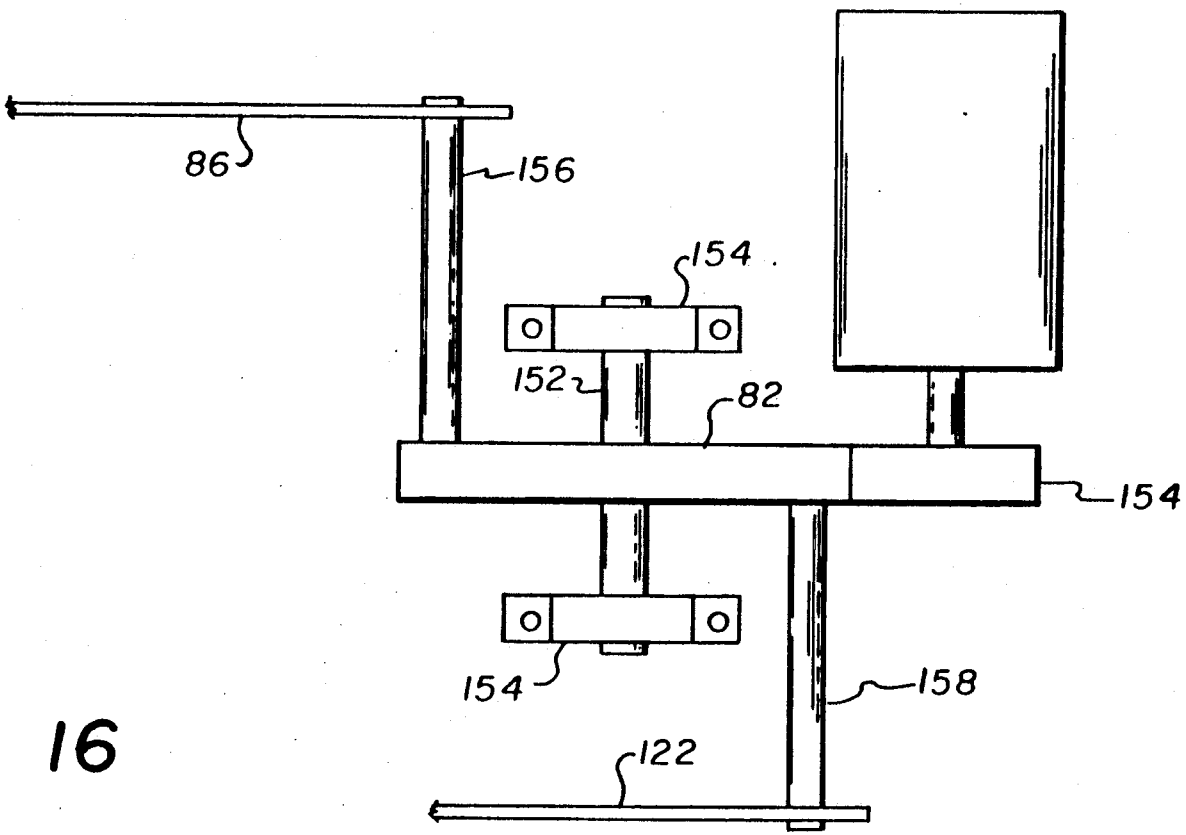
FIG. 16 is a diagrammatic representation of an alternate drive arrangement used to move the movable guides.

Referring to FIG. 16 there is illustrated in schematic form an alternate arrangement by which the crank 82 may be rotated, like numerals indicating like parts previously described. In this embodiment crank 82 rotates about an axle 152 which is secured to mechanism 10 by a pair of mounting brackets 154. Motor 96 drives crank 82 through the use of an intermediate gear 154 which engages the outer surface of crank 82. Links 86 and 122 are secured to crank 82 by connecting pins 156, 158. This allows for rotation of crank 86 only in a single direction to activate either of the guides. By properly selecting the length of the slots in the links and their location on the crank the crank will activate only one of the guides at any given time. This avoids the necessity of having a reversible motor.

Figure 17:
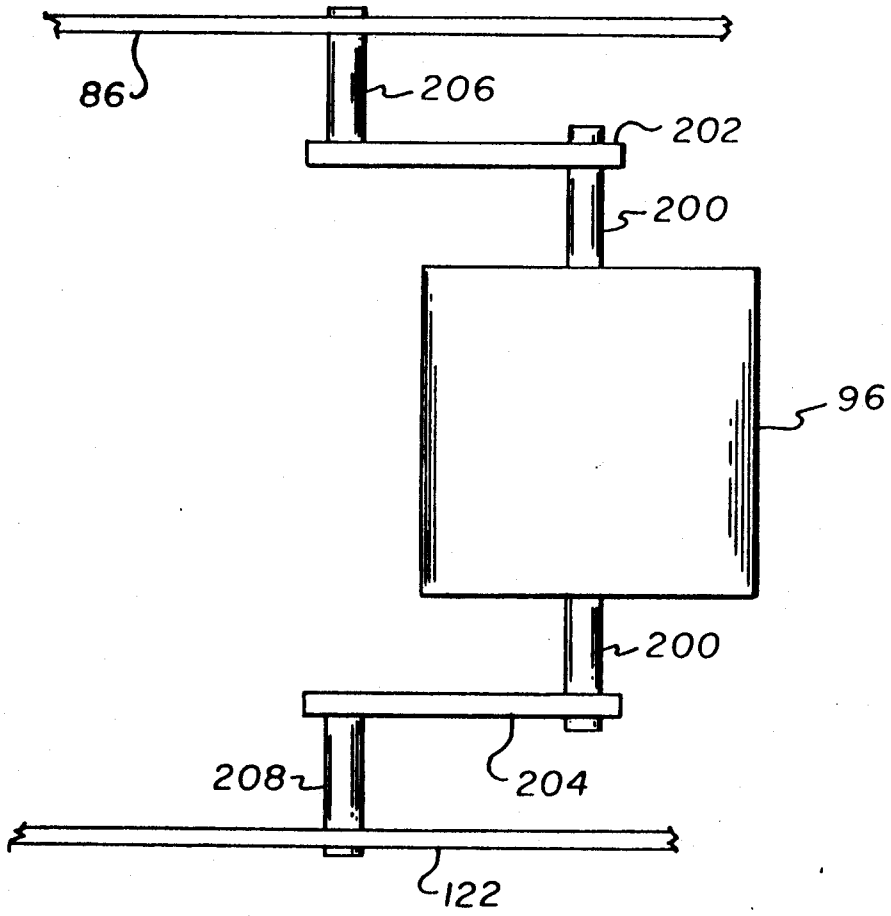
FIG. 17 is a diagrammatic representation of yet another alternate drive arrangement used to move the movable guides of the present invention.

FIG. 17 illustrated yet another method by which a single directional motor 96 may be used to drive the links. In this embodiment motor 96 is located between the links 86,122. The motor 96 is provided with drive shaft 200 which extends from opposite sides of the motor and drive cranks 202,204 which are connected to drive pins 206,208 which are slideable connected to links 86, 122 in a manner similar to that previously described.

The present invention provides a mechanism for registering sheets of different sizes wherein movable guides are reliably moved between raised and lowered positions. It is to be understood that various other changes may be made without departing from the scope of the present invention, the present invention being limited by the following claims.

What is claimed is:

1. In a mechanism for registering sheets of different sizes relative to a station, the registration mechanism having a platen having a top surface for receiving a sheet with the sheet being movable along the surface and extending toward the station, a registration member located along the surface and extending toward the station, the registration member being engagable by the sheet for guiding the sheet toward the station, a first urging guide extending along the surface in spaced relation to the registration member, and means for urging the sheet toward the station, the improvement comprising:

a second urging guide extending along the top surface and toward the station between said registration member and said first urging guide, said second urging guide being rotatably mounted beneath the top surface of said platen such that said second urging guide rotates about an axis which is substantially parallel to its length between (1) a first position wherein the second urging guide lies substantially flat on said top surface and (2) a second position wherein the second urging guide projects above the top surface.

2. In a mechanism as set forth in claim 1 wherein said means for moving the sheet toward the station comprises a guide projecting above the top surface which is located relative to the registration member so that the guide imparts a component of force onto the sheet urging the sheet toward the station.

3. In a mechanism as set forth in claim 1 further comprising means for moving the second urging guide between the first and second positions.

4. In a mechanism as set forth in claim 1 further comprising means for locking the second urging guide in the first or second position.

5. In a mechanism as set forth in claim 4 wherein said means for locking the second urging guide in the first or second position comprises a spring having a first end secured to the platen and a second end secured to the second urging guide.

6. In a mechanism as set forth in claim 3 wherein said means for moving said second urging guide between the first and second positions comprises an over the center crank mechanism, said over the center crank mechanism comprising a crank mounted beneath the surface of said frame, drive means for rotating said crank, a first link having a first end secured to said second urging guide beneath said top surface and a second end having a slot therein through which the link is slideably secured to said crank.

7. In a mechanism as set forth in claim 6 further comprising means for biasing said second urging guide in the first and second positions after said second urging guide has been moved to either of said positions,

8. In a mechanism as set forth in claim 7 wherein said means for biasing the second urging guide in the first and second positions comprises a spring having a first end secured to the platen and a second end secured to the second urging guide.

9. In a mechanism as set forth in claim 6 further comprises means for monitoring the position of said crank comprising a flag member secured to said crank, and at least one sensor for monitoring the position of said flag on said crank.

10. In a registration mechanism as set forth in claim 1 further comprising a third urging guide extending along the surface between said second urging guide and said registration member, said third urging guide being rotatably mounted beneath the top surface of said platen such that said third urging guide rotates about an axis which is substantially parallel to its length between a (1) first position when the third urging guide lies substantially flat on said top surface, and (2) a second position wherein the third urging guide projects above the top surface, the third guide when in its second position being located between the second urging guide and registration member, and means for controlling the movement of said second and third urging guides so that (I) the second urging guide can be in its second position, or (II) the third urging guide can be in its second position, or (III) both the second or third urging guides can be in the respective first position, so that sheets of three different dimensions can be registered by the mechanism.

11. In a mechanism according to claim 10 wherein said means for controlling movement of the second and third urging guides comprises an over the center crank mechanism mounted beneath the top surface, said over the center crank mechanism comprising a crank, drive means for rotating said crank, a first link having a first end secured to said second urging guide and a second end having a slot through which the first link is slideably secured to said crank, first biased means for biasing said second urging guide in the first and second positions, a second link member having a first end secured to said third urging guide and a second end having a slot through which the second link is slideably secured to said crank, said drive means capable of rotating and moving said second link so as to cause said third urging guide to move between the first and second positions, second bias means for biasing said third urging guide in the first position and second positions.

12. In a mechanism for registering sheets of different sizes relative to a station, the registration mechanism having a platen having a top surface for receiving a sheet being moveable along the surface and extending toward the station, a registration member located along the surface and extending toward the station, the registration member being engagable by the sheet for guiding the sheet toward the station, the improvement comprising:

at least one urging guide extending along the surface of said platen at a predetermined distance from said registration member, said at least one urging guide member being rotatably mounted beneath the top surface of said platen such that said at least one urging guide rotates in a direction substantially parallel to its length between a (1) first position wherein at least one urging guide lies substantially flat on said top surface, and (2) a second position wherein at least one urging guide projects above the top surface.

13. In a mechanism as set forth in claim 12 further comprising means for moving the at least one urging guide between the first and second positions.

14. In a mechanism as set forth in claim 13 wherein said means for moving said at least one urging guide between the first and second positions comprises an over the center crank mechanism, said over the center crank mechanism comprising a crank mounted beneath the surface of said frame, drive means for rotating said crank, a first link having a first end secured to said second urging guide beneath said top surface and a second end having a slot therein through which the link is slideably secured to said crank.

15. In a mechanism as set forth in claim 14 further comprising means for locking the at least one guide in the first and second positions, said means for locking the at least one guide in the first and second positions comprises a spring having first and second ends, said first end being secured to the at least one guide and the second end being secured to the platen.

16. In a mechanism as set forth in claim 12 further comprising means for monitoring the position of said crank, said means for monitoring the position of said crank comprising a flag member secured to said crank, and at least one sensor for monitoring the position of said flag on said crank.

17. In a mechanism for registering sheets of different sizes relative to a station, the registration mechanism having a platen having a top surface for receiving a sheet with the sheet being movable along the surface and extending toward the station, and a registration member located along the surface and extending toward the station, the registration member being engagable by the sheet for guiding the sheet toward the station, a first urging guide extending along the surface in spaced relation to the registration member, and a guide projecting above the top surface and being located relative to the registration member so that the guide imparts a component of force onto the sheet urging the sheet toward the registration member, the improvement comprising:

a second urging guide extending along the top surface and toward the station between said registration member and said first urging guide, said second urging guide being rotatably mounted to said mechanism such that said second urging guide rotates between (1) a first position wherein the second urging guide lies substantially flat on said top surface and (2) a second position wherein the second urging guide projects above the top surface;

means for locking said second urging guide in the first and second positions.

18. In a mechanism as set forth in claim 17 wherein said means for locking said urging guide in the first or second position comprises an over the center crank mechanism for moving the second urging guide between the first and second positions.

19. In a mechanism as set forth in claim 18 wherein said crank mechanism comprises a crank mounted beneath the surface of said frame, drive means for rotating said crank, a first link having a first end secured to said second urging guide beneath said top surface and a second end having a slot therein through which the link is slideably secured to said crank, and a spring for biasing said guide in the locked position when said guide is positioned in either the first or second position.

* * * * *